United States Patent [19]

Genth

[11] Patent Number: 4,811,680

[45] Date of Patent: Mar. 14, 1989

[54] GULLWING-TYPE DECK HATCH ASSEMBLY

[75] Inventor: Richard E. Genth, Englewood, Fla.

[73] Assignee: Donzi Marine Corporation, Tallevast, Fla.

[21] Appl. No.: 12,158

[22] Filed: Feb. 9, 1987

[51] Int. Cl.[4] ..... B63B 19/14

[52] U.S. Cl. ..... 114/201 R; 114/211; 49/476

[58] Field of Search ..... 114/173, 177, 178, 201 R, 114/211; 296/202, 146, 219; 49/381, 402, 475, 476

[56] References Cited

U.S. PATENT DOCUMENTS

| | | | |
|---|---|---|---|
| D. 193,697 | 9/1962 | Lo Turco . | |
| D. 292,511 | 10/1987 | Brown et al. | D12/317 |
| 1,241,385 | 9/1917 | Hunt | 114/201 R |
| 1,507,284 | 9/1924 | Hensen . | |
| 2,903,296 | 9/1959 | Barenyi | 296/146 |
| 2,938,749 | 5/1960 | Podolan et al. | 296/202 |
| 3,492,044 | 1/1970 | Mycroft | 296/146 |
| 3,834,340 | 9/1974 | Thorpe . | |
| 3,861,083 | 1/1975 | Goiot . | |
| 3,976,024 | 8/1976 | Fillery . | |
| 4,239,008 | 12/1980 | Conlon . | |
| 4,261,612 | 4/1981 | Chryster et al. | 296/146 |
| 4,300,440 | 11/1981 | Holter . | |
| 4,385,580 | 5/1983 | Davidson . | |
| 4,415,197 | 11/1983 | Meyer . | |

*Primary Examiner*—Galen Barefoot
*Assistant Examiner*—Stephen P. Avila
*Attorney, Agent, or Firm*—Jack Q. Lever, Jr.; Karen M. Gerken; Martin P. Hoffman

[57] ABSTRACT

A deck hatch assembly for marine craft is formed in the upper deck surface of the marine craft on the port and starboard sides. A submerged surface is integrally formed in the upper deck surface, being provided with a hatch opening surrounded by a raised peripheral ridge. The raised ridge, together with the submerged surface and the upper deck surface, forms a drain channel for directing water away from the stern of the marine craft. A pivotably mounted hatch cover is provided for normally sealing and closing off the hatch opening. The hatch cover may be raised upwardly from the bulkhead of the marine craft toward the stern for the purpose of providing ventilation to below deck compartments and for allowing access to the upper deck surface from below deck areas. A pair of gas spring assemblies is provided for positively and automatically retaining the hatch cover in the closed, or any one of a number of open positions. The hatch cover, in the closed position, is completely flush with the upper deck surface and is adapted to conform to the configuration of any deck, including styling lines thereof.

6 Claims, 3 Drawing Sheets

GULLWING-TYPE DECK HATCH ASSEMBLY

BACKGROUND OF THE INVENTION

1. Field of the Invention

The invention generally pertains to deck hatches for boats or other marine craft. More particularly, the invention relates to deck hatches provided on the deck surface of a boat for the purpose of providing ventilation to the cabin areas below deck and for allowing access to the topside of the deck area from a below-deck location.

It is desirable to provide deck-mounted hatches on marine vessels, such as pleasure boats and fishing boats, in order to achieve cabin ventilation by opening the hatch in periods of fog or rainy weather, or as required, to achieve an acceptably wholesome atmosphere below deck. Optimal ventilation is obtained by allowing for selective opening of the hatch cover to a fully open position, or to any one of a number of intermediate open positions, of the hatch cover. The hatch cover may thus be opened to any extent so that wind and air will be directed below deck as desired to meet individual comfort requirements. Although the hatch cover will primarily be opened while the boat rides at anchor, it may, nonetheless, be desired to open the hatch cover in some instances while the boat is underway. It is thus advantageous that such a hatch cover be capable of being opened easily and safely from below deck.

It is also desirable to provide marine craft with deck-mounted hatches as a means for allowing access to the topside deck area from the cabin or other below deck compartment. A hatch of this type, in order to accomplish this objective, should present an unobstructed hatch opening to the below deck occupant for gaining access to the upper deck. Therefore, it is necessary that the hatch cover be capable of being positively and securely held in an open position so as to prevent the hatch cover from inadvertently closing and, hence, resulting in potential injury Similarly, the means provided for retaining the hatch cover in its open position should be arranged and located so as to prevent blockage of the hatch opening and prohibit accidental knocking, jarring or other disablement of the retaining means on part of the occupant.

The commercial acceptability of a deck-mounted hatch in the pleasure and fishing boat markets, which are characterized by particularly sophisticated purchasers, also depends in large part on styling considerations and aerodynamic criteria. A deck hatch, in order to be commercially utile, is preferably capable of being formed to conform to the contour of any deck shape and to incorporate any styling lines in the deck surface so as to be aesthetically harmonious and appealing. It is further desirable that the deck hatch be formed completely flush with the surface of the deck so as to blend in completely with the deck shape when the hatch cover is in the closed position The hatch is thus aerodynamically continuous with the shape of the deck lines and offers no additional aerodynamic drag when in the closed position. Additionally, the hatch, in the closed position, provides a continuous deck surface upon which users of the boat may stand upon or walk.

Prior art deck hatches directed to the foregoing objectives have proven to be problematic and have failed to receive commercial acceptance. Prior art deck hatches wherein the hatch cover is raised in relation to the deck surface fail to meet prevalent styling and aerodynamic demands. Deck hatches utilizing elaborate frames and numerous parts are commercially impractical. Moreover, prior attempts at providing deck-mounted hatches frequently failed to prevent water leakage through the hatch opening into the underlying compartment, thus seriously undermining their utility.

Thus, the need exists to provide a deck-mounted hatch for marine craft which successfully achieves ventilation of below deck compartments and which allows for access through the hatch from below deck to the upper deck area while being aesthetically appealing, aerodynamically efficient, structurally sound, capable of prohibiting water leakage into below deck areas and permitting safe and easy utilization.

The subject invention achieves the foregoing objectives by providing a deck hatch assembly comprising a submerged surface integrally formed in the deck and having a hatch opening therein which is surrounded by a raised peripheral ridge forming a drainage channel. The present invention further provides a hatch cover, pivotable about a pivot mechanism, which opens from the bulkhead inwardly toward the stern of the boat. A pair of gas spring assemblies is provided for positively retaining the hatch cover in a fully open, or any one of a number of intermediate open, positions. Both the pivot mechanism and the gas spring assemblies are structurally arranged so as not to obstruct the hatch opening when the hatch cover assumes an open position. The deck hatch assembly is formed as an integral molding, adapted to conform to the contour or configuration of any deck, including any deck styling lines. In the closed position, the hatch cover completely seals and closes off the hatch opening and is completely flush with the deck surface so as not to create additional aerodynamic drag. The invention contemplates providing a deck hatch assembly on the port and starboard side of the boat such that, in the open position, the hatch covers are disposed in gullwing-type fashion so as to optimize the ventilation and access functions of the hatch assembly.

2. Description of the Prior Art

It is generally known in the prior art to provide a deck hatch on marine craft including a hatch cover which may be pivotally opened with respect to a hatch opening. For example, U.S. Pat. No. 4,385,580, issued on May 31, 1983 to Davidson, teaches a marine door unit comprising a door means formed of a plurality of plates and being hingedly connected to a frame means which defines the door opening in a fishing platform on a boat. The door means is attached to the frame means by a continuous piano-type hinge and is provided with a handle for moving the door means from a closed to n open position.

It is also known in the prior art to provide a deck hatch having a hatch cover which is movable from a closed to a fully open position, or any intermediate position, and which is positively retained in said position. For example, U.S. Pat. No. 3,976,024, issued on Aug. 24, 1976 to Fillery, discloses a boat hatch including a hatch cover and a base frame. The frame is secured around a deck opening with the cover being connected thereto by means of a plurality of releasable hinge couplings, or espagnolette bolts. The cover may be opened along either of two of its opposite edges by disconnecting the bolts. The cover can be progressively opened from a closed to an open position, or to any intermediate position, and is retained in said position by means of stay mechanisms. The stay mechanisms each comprise a pair of slidably-connected stay members which are locked in position by a hand screw.

U.S. Pat. No. 3,861,083, issued on Jan. 21, 1975 to Goiot, teaches a hatch mounted on a frame which is fixed to the roof and deck of a boat. A plurality of lugs are provided for articulating the hatch to the frame. A pair of telescopic bars, in conjunction with a lock screw, serves to hold the hatch in a position corresponding to a predetermined opening of the hatch.

The prior art further teaches the provision of a deck hatch for purposes of providing cabin ventilation. U.S. Pat. No. 4,300,440, issued on Nov. 17, 1981 to Holter, is directed to a ventilating hatch assembly including a coaming provided around an opening in the deck and extending thereabove, a detachable hatch frame which fits around the coaming, and a hatch cover pivotally attached to the hatch frame by means of a piano hinge. The hatch cover is maintained at a selected opening position by means of a spring assembly comprising a tension coil spring attached at one end to a cross member, and at the other end to a car which may be selectively positioned on a track.

The prior art also discloses means for closing an opening in a boat hull wherein water is directed to flow downwardly away from the opening. For instance, U.S. Pat. No. 3,834,340, issued to Thorpe on Sept. 10, 1974 on a continuation-in-part of U.S. Pat. No. 3,674,170, teaches a container for utilization in an opening in a boat hull and comprising a bin which is adapted to fit within an opening formed in a recess in the boat hull. The surface of the recess is sunk below the level of the deck and is provided, adjacent the opening, with a raised and bevelled marginal edge so as to form an inclined drainage channel. A separable hatch cover closes the bin, being connected to the hull by means of a retaining strap.

It is also known in the prior art to provide a hinged hatch roof assembly in a vehicle cab for serving as an escape hatch and for providing ventilation. In this regard, U.S. Pat. No. 4,415,197, issued on Nov. 15, 1983 to Meyer, discloses an opening in the roof of a vehicle cab having a framework to which is connected a hatch 32. A desired open position of the hatch is obtained by pivoting of a pair of support arms relative to the roof, with the hatch being pivoted relative to the support arms.

The prior art fails to teach or suggest a fully molded deck hatch assembly which is specifically adapted to conform to the camber or contour of a particular deck surface, including any styling lines thereof, which is water-tight, aerodynamically efficient and which is incorporated in a deck surface in gullwing-type fashion to effectively provide for cabin ventilation as well as possible access to the deck surface from areas below.

SUMMARY OF THE INVENTION

The present invention is directed to a deck hatch assembly comprising submerged surface integrally molded with the deck surface of a boat and extending from the stern outwardly through the bulkhead. The submerged surface is connected to the upper deck surface by a pair of vertical side walls and a vertical rear wall. A hatch opening in communication with the cabin or other below deck compartment is formed in the submerged surface and is surrounded by a raised peripheral ridge having a seal secured therearound. The peripheral ridge, together with the submerged surface and the vertical side and rear walls, forms a drain channel for directing water that may collect therein away from the stern of the boat. The hatch opening is thus protected from the entry of water therethrough to the cabin areas below.

The deck hatch assembly further includes a hatch cover defined by a top wall, a front wall and a pair of side walls. A pair of pivot mechanisms pivotably connect the hatch cover to the vertical side walls which join the submerged surface to the upper deck surface. The hatch cover is thus pivotably mounted for rotation around an axis through the pivot mechanism from a closed position, wherein the hatch cover is sealed against the raised ridge and tightly closes off and seals the hatch opening, to an open position, wherein the hatch cover is upwardly raised from the bulkhead side toward the stern of the boat. A pair of gas spring assemblies supports the hatch cover in the fully open position, or any one of a number of intermediate open positions. The pivot mechanisms and the gas spring assemblies are located so as not to obstruct the hatch opening when the hatch cover is in an open position or interfere with operation of the hatch cover.

The hatch cover may be easily raised from below deck simply by pushing upwardly thereon the desired amount and is locked in place automatically by means of the gas spring assemblies, without the need for operating or unlocking any mechanisms on or near the deck hatch assembly from either below or above deck. The gas spring assemblies, due to their location, are precluded from being inadvertently actuated so s to cause accidental closure of the hatch cover. The ability of the gas spring assemblies to be easily and automatically locked in position also reduces the possibility of accidental closure of the hatch cover. The hatch cover may similarly be raised from above deck by grasping the front wall and lifting the hatch cover upwardly. The deck hatch assembly thus presents a clear and unobstructed opening for the purposes of providing ventilation to the below deck areas and possible access to the upper deck. The opening direction of the hatch cover inwardly toward the stern allows for efficient direction of wind and air to the compartments below deck. Additionally, the latitude in open positions characteristic of the deck hatch assembly makes it possible to adapt the ventilation effect to suit individual comfort needs.

The present invention contemplates a deck hatch assembly being provided in the deck surface at the port and starboard side of the stern in gullwing-type fashion. This arrangement not only provides optimal cabin ventilation and, indeed, cross-ventilation, but is also aesthetically appealing. The gullwing-type arrangement provides, additionally, for more widely distributed access to the deck surface, allowing communication from below deck to the upper deck surface at opposite sides of the stern.

The submerged surface and the top surface of the raised ridge formed in the deck, as well as the top wall of the hatch cover, are all parallel surfaces to each other. These surfaces, together with the front wall of the hatch cover, conform to the contour of the deck and may include any styling lines thereof. The top and front walls of the hatch cover in the closed position are completely flush with the upper deck surface, so as not to present additional aerodynamic drag.

These, and other salient objects and features of the invention will become more apparent to those skilled in the art in view of the following description, taken in conjunction with the accompanying drawings.

DESCRIPTION OF THE PREFERRED EMBODIMENT

Figure 1:
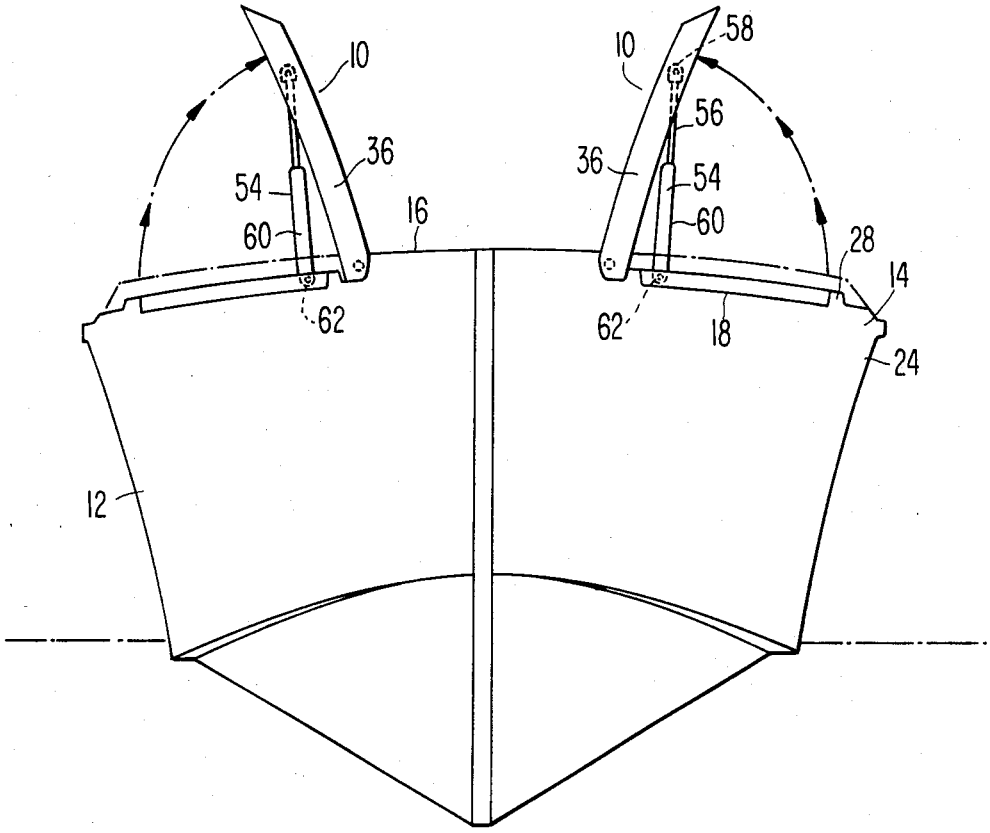
FIG. 1 is a front plan view of an integral boat hull and deck having the gullwing-type hatch assembly of the present invention.
Figure 3:
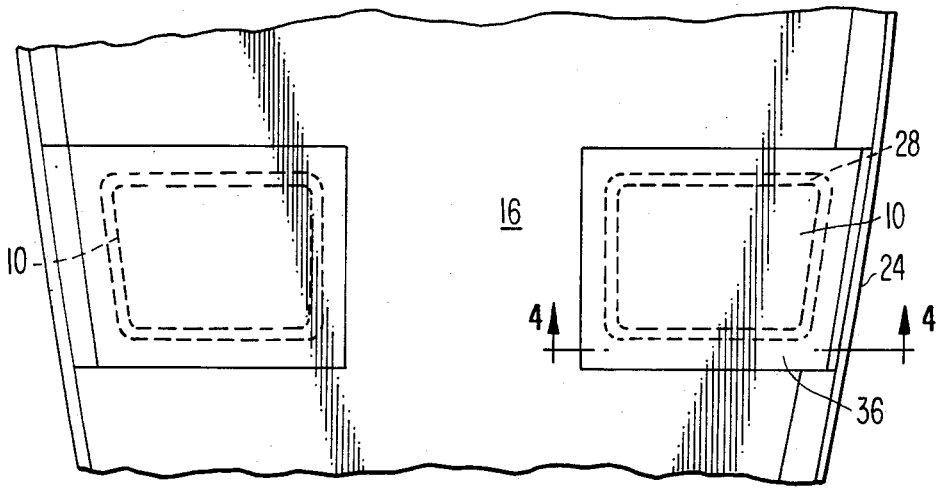
FIG. 3 is a partial top plan view of the deck showing the hatch covers of the gullwing-type hatch assembly in the closed position.
Figure 2:
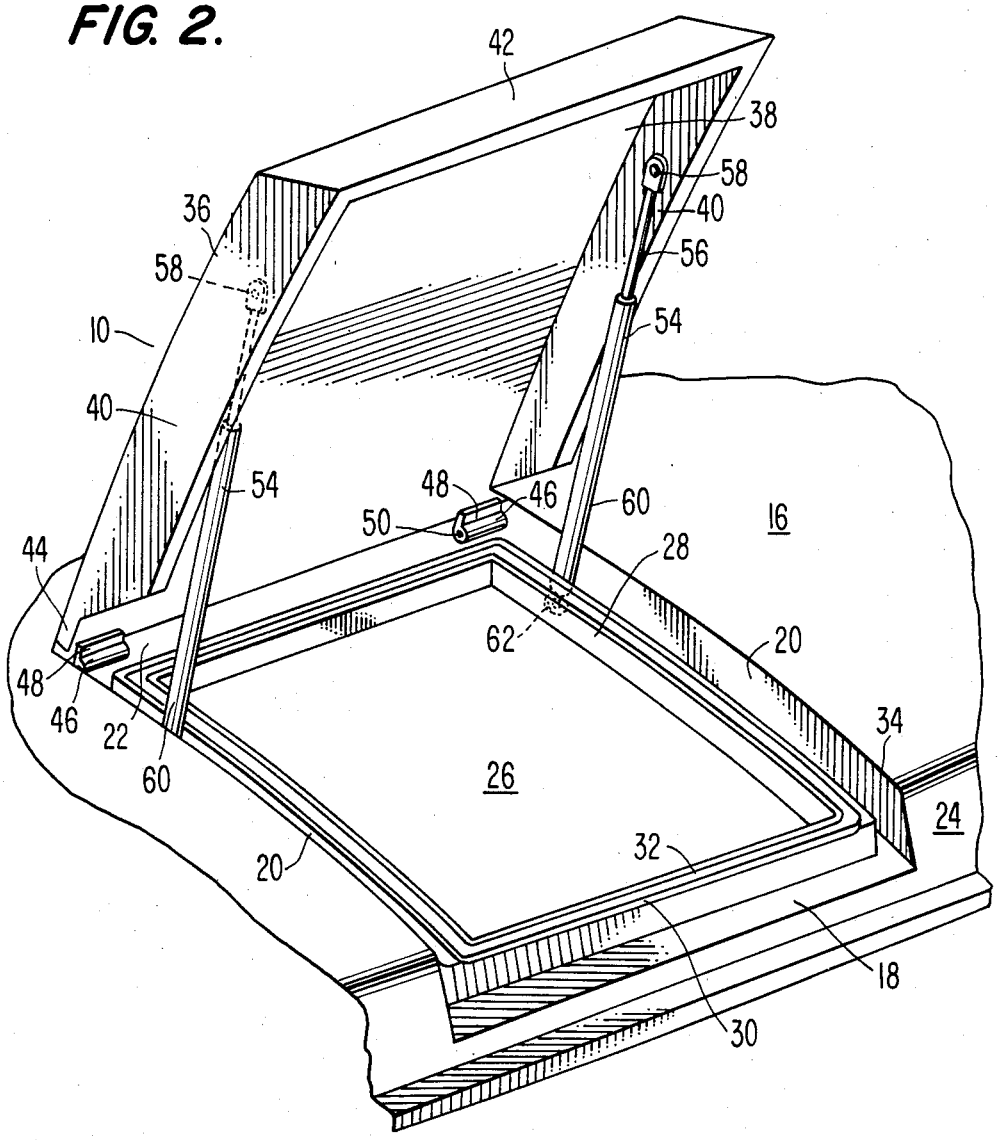
FIG. 2 is a perspective view of the gullwing-type hatch assembly of the present invention with the hatch cover being shown in the open position.

With reference to the drawings and, in particular, to FIGS. 1-3, there is shown a gullwing-type deck hatch assembly indicated generally at 10 according to the principles of the present invention. FIG. 1 depicts a boat hull 12 having deck 14, which may be molded integral with the hull or which may be molded separately therefrom and subsequently assembled to the hull according to conventional techniques. The deck 14 is defined by an upper deck surface 16 in which is provided the deck hatch assembly 10. As is best depicted in FIGS. 1 and 3, a deck hatch assembly 10 is provided in the upper deck surface 16 on the port and starboard side of the stern of the boat.

Figure 4:
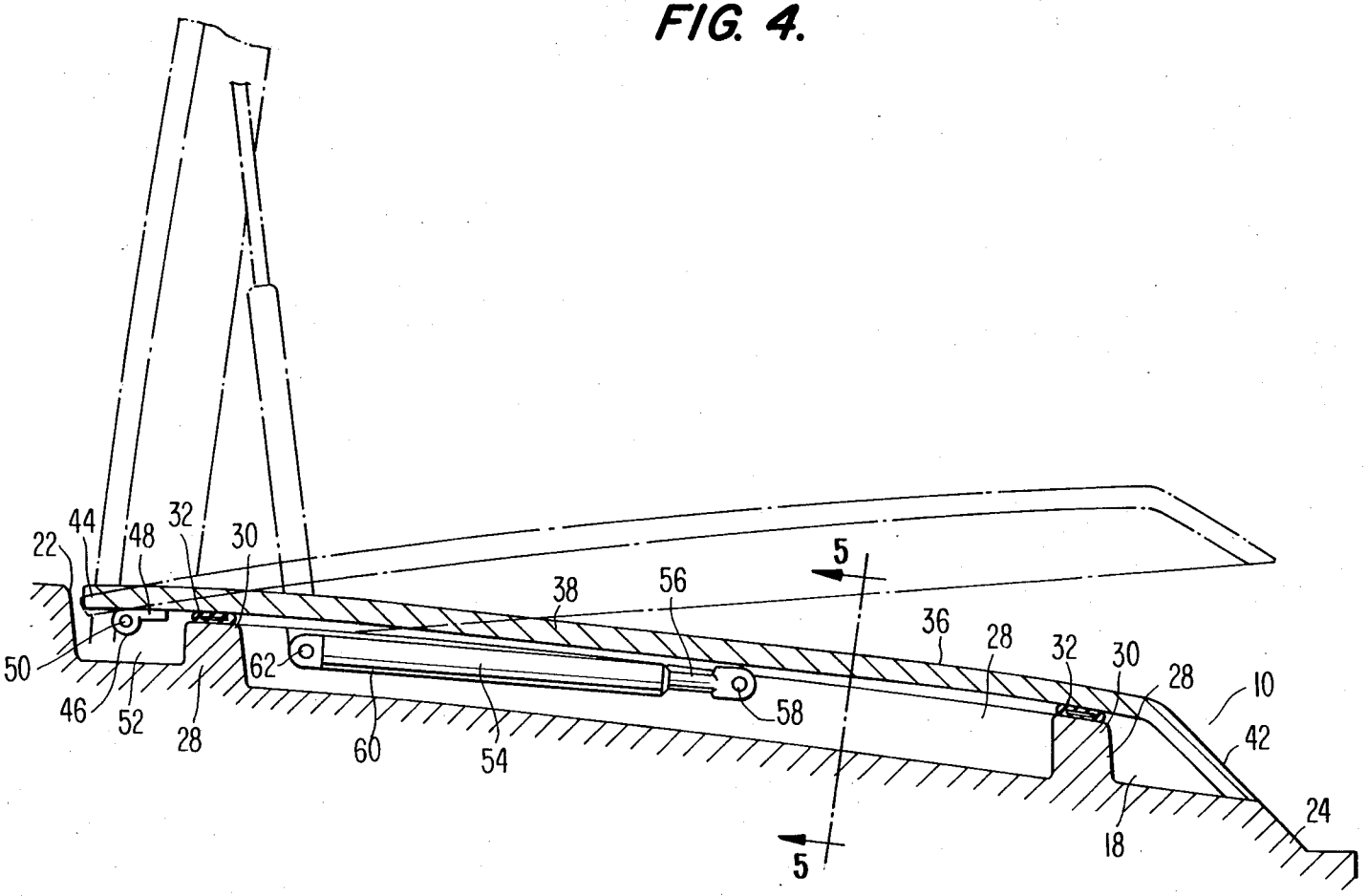
FIG. 4 is a vertical sectional view taken along line 4—4 of FIG. 3 showing the hatch cover in the closed position, with the open positions for the hatch cover being shown in phantom.

With particular reference to FIGS. 1 and 2, each deck hatch assembly 10 comprises a submerged generally planar surface 18 molded in the upper deck surface 16 and conforming generally to the contour or camber of the deck. The planar surface 18 merges with the upper deck surface 16 by means of vertical side walls 20 and vertical rear wall 22. As can be seen in FIGS. 1, 2 and 4, the surface 18 extends from the deck, and in particular from the rear wall 22, outwardly through the bulkhead 24. The planar surface 18 is interrupted by a hatch opening 26, which communicates with the cabin or other below deck area and which is separated from the planar surface by an integrally molded raised peripheral ridge 28. The peripheral ridge is provided with a generally planar top surface 30 which similarly conforms to the configuration and contour of the deck. A waterproof seal 32 is secured to the top surface 30 of the ridge 28 entirely therearound. As is best depicted in FIG. 2, the peripheral ridge 28, in conjunction with the submerged planar surface 18, vertical side walls 20, and vertical rear wall 22, together form a peripheral drain channel 34. The drain channel 34 is particularly adapted to direct water which may collect therein outwardly and downwardly through the bulkhead 24 and away from the hatch opening, thereby preventing water from entering the below deck compartments through the hatch opening when the hatch cover is opened.

Each deck hatch assembly further includes a hatch cover 36 defined by a planar top wall 38, a pair of side walls 40, and a front wall 42. The hatch cover is formed of an integral molding with the top and front walls likewise conforming to the contour of the deck. The side walls 40 of the hatch cover also conform to deck configuration and possess a vertical height corresponding to the submerged depth of planar surface 18, said depth being defined by the vertical height and contour of the side walls 20. The independent rear edge 44 of the hatch cover opposite the front wall 42 is hingedly connected at its outer ends to the vertical side walls 20 by means of a pair of identical pivot mechanisms 46.

As is depicted most clearly in FIGS. 2 and 4, each pivot mechanism 46 includes a pivot plate member 48 which is secured to the interior surface of the top wall 38 of the hatch cover by any suitable securing means (not shown). The pivot plate 48 is rotatably mounted on a roller or pin member 50 secured at one end to the vertical side wall 20. The hatch cover 36 is thus pivotably mounted for rotation about an axis defined by the horizontal axis of the pin member 50 from a closed to an open position.

FIG. 4 most clearly depicts the normally closed position of the hatch cover wherein the hatch cover fully covers and closes off the hatch opening 26. As can be seen therein, in the closed position, the interior surface of the top wall 38 of the hatch cover rests tightly against the seal 32 so as to prevent the entry of water through the hatch opening into the compartments below. The exterior surface of the top wall 38 of the hatch cover is completely flush with the upper deck surface 16 and, together with the front wall 42 of the hatch cover, which is also flush with the deck, conforms completely to the contour of the deck. The side walls 40 of the hatch cover, in the closed position of the hatch cover, are disposed inside the drain channel 34 adjacent the vertical side walls 20. It is therefore apparent that the deck hatch assembly does not contribute additional aerodynamic drag to the boat.

It is to be particularly noted that the submerged surface 18, the top surface 30 of the peripheral ridge 28, and the exterior surface of the top wall 38 of the hatch cover 36 may all be molded to conform to an desired deck camber, or contour, and may, additionally, be molded so as to include any desired styling lines. The sole requirement for successful performance of the deck hatch assembly is that these surfaces are parallel to each other. Moreover, as indicated in FIG. 4, the submerged surface 18 need not be continuous, but may be stepped in such a manner that the portion 52 of the submerged surface between the peripheral ridge 28 and the vertical rear wall 22 is at a higher elevation with respect to the upper deck surface 16 then the portions of the submerged surface between the peripheral ridge and the vertical side walls 20 and between the peripheral ridge and the bulkhead 24. The stepped portion 52 is, however, also required to be parallel with the surfaces 18, 30 and 38 as discussed above. Furthermore, the submerged depth of this stepped portion 52 must be sufficient to accommodate the independent rear edge 44 of the hatch cover when the hatch cover is pivoted to the open position shown in phantom in FIG. 4.

With further reference to FIG. 4, the hatch cover 36 is shown in phantom as being raised from the closed to the open position. This movement is accomplished simply by one pushing upwardly from below deck against the interior surface of the hatch cover so as to cause the hatch cover on the bulkhead side to move upwardly, pivoting about the pin members 50 of the pivot mechanisms 46. This action may be effortlessly executed from below deck, without the need for unlocking or operating any mechanisms in or around the hatch assemblies.

The hatch cover may similarly be easily opened from above deck by grasping and lifting upwardly the front wall 42. As illustrated in FIG. 4, and also in FIGS. 1 and 2, the hatch cover is pivoted upwardly toward the stern of the boat so as to be disposed in a favorable position for directing wind and air to below deck compartments for ventilation purposes. It is also to be noted that the hatch opening 26, in the open position of the hatch cover 36, is not in any way obstructed by the pivot mechanisms 46, the pivot mechanisms being located proximate the rear wall 22 between the raised ridge 28 and the rear wall 22.

As specifically shown in FIGS. 1 and 3, a deck hatch assembly 10 is provided in the deck surface on the port and starboard side of the boat such that the hatch cover 36, pivoted upwardly toward the stern of the boat in the open position, assume a gullwing-type configuration. In addition to their aesthetic appeal, the deck hatch assemblies arranged in this manner are particularly capable of providing ventilation and, most importantly, cross-ventilation to the cabin areas below deck. The gullwing-type arrangement of the deck hatch assemblies allows further for more widely distributed and effective access to the upper deck surface from the cabin areas, providing possible access to a much greater portion of usable upper deck space from the areas below.

The hatch cover 36 of the present deck hatch assembly is particularly adapted to assume, not only the fully open position shown in FIGS. 1 and 2 and in phantom in FIG. 4, but any number of intermediate positions, one of such positions also being shown in phantom in FIG. 4. The ability of the hatch cover to assume, and to be positively and securely retained, in a variety of open positions allows the occupants of the cabin areas to adjust the deck hatch opening so as to provide the degree of cabin ventilation desired in order to meet individual standards of comfort.

Figure 5:
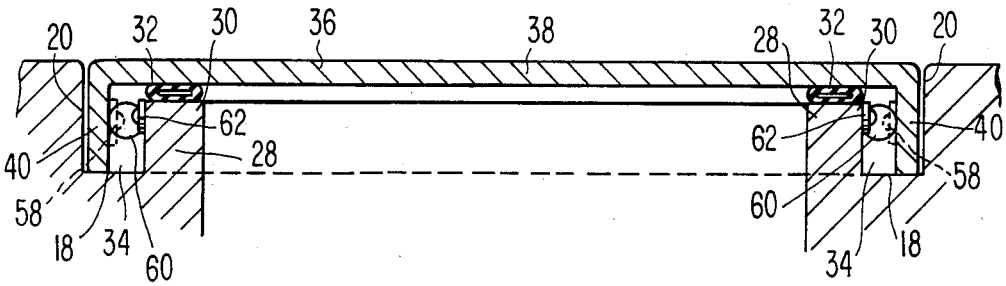
FIG. 5 is a vertical sectional view taken along line 5—5 of FIG. 4 showing the hatch cover in the closed position.

In order to achieve this latitude in open positions, each deck hatch assembly is provided with a pair of identical conventional gas spring assemblies 54. Each gas spring assembly 54, as depicted primarily in FIGS. 2, 4 and 5, includes a rod member 56 which is pivotally secured at its upper end 58 to the interior of the side wall 40 of the hatch cover 36. The rod member 56 is secured to the side wall toward the front end, or bulkhead end, of the hatch cover, being spaced a suitable distance from the hatch cover front wall 42. The opposite end of the rod member 56 is telescopically and slidably received in one end of a gas cylinder 60. The opposite end of the cylinder is pivotally secured at 62 to the raised peripheral ridge 28 toward the rear end of the ridge.

In the closed position of the hatch cover shown in FIG. 4, it can be seen that rod member 56 is telescopically received within cylinder 60, with the entire gas spring assembly being disposed beneath the hatch cover and within the drainage channel 34 between the raised peripheral ridge 28 and the vertical side wall 20. In this location, the gas spring assembly does not interfere with or obstruct the hatch opening 26 when the hatch cover assumes any of its possible open positions. The gas spring assembly is, in this manner, precluded from being inadvertently jarred or damaged while an occupant is utilizing the hatch opening to acquire access to the upper deck surface.

In operation, the gas spring assembly behaves like a conventional pneumatic cylinder being capable of being automatically locked in any position to which the hatch cover is raised by means of the force exerted by the gas in cylinder 60 against the rod 56. It is only necessary to manually hold the hatch cover in the desired raised position for a few moments to allow the cylinder 60 to fill with gas so as to maintain rod 56 in the position where it has slid outwardly from the cylinder. This force exerted against the rod, in conjunction with the ability of the rod and cylinder to pivot about points 58 and 62 enable the gas spring assembly to positively and securely retain the hatch cover in the desired open position. The force of the gas against rod 56 in any position can be overcome for purposes of opening or closing the hatch cover simply by manually pushing up or down on the hatch cover.

While the invention has been described in conjunction with a preferred embodiment, it is to be understood that many alternatives, modifications and variations will be apparent to those skilled in the art in light of the foregoing description. Accordingly, this invention is intended to embrace all such alternatives, modifications and variations which fall within the spirit and scope of the appended claims.

What is claimed is:

1. A deck hatch assembly for marine craft having a hull, a bulkhead, a deck and an upper deck surface, said deck hatch assembly comprising a submerged surface integrally formed in said upper deck surface and merging therewith by means of a pair of upper deck surface side walls and an upper deck surface rear wall, said submerged surface extending at one side through said bulkhead, a hatch opening formed in said submerged surface communicating with an area below said deck, a raised peripheral ridge surrounding said hatch opening and being formed integral with said upper deck surface, said raised peripheral ridge being defined by a planar top surface and first and second generally vertical walls, a seal secured to said top surface of said ridge, a drainage channel defined between said ridge, said submerged surface and said upper deck surface side and rear walls, a hatch cover pivotably associate with said hatch opening, said hatch cover having a rear edge, a pair of pivot mechanisms securing said rear edge with respect to said hatch opening for pivotable movement of said hatch cover from a closed position wherein said hatch cover is supported by said top surface of said ridge so as to close off said hatch opening, to an open position wherein said hatch cover is raised upwardly from said bulkhead toward said marine craft whereby said hatch opening is uncovered and unobstructed, a pair of gas spring assemblies pivotably mounted between said hatch cover and proximate said ridge for retaining said hatch cover in said open position, said gas spring assemblies and said pivot mechanisms being located so as not to obstruct said hatch opening, said hatch cover being flush with said upper deck surface and said bulkhead in said closed position, said top surface of said ridge being adapted to uniformly support said hatch cover in said closed position, said submerged surface, said top surface of said ridge and said hatch cover all being parallel to each other, said ridge, said submerged surface, and said upper deck surface together being formed of an integral molding, said deck hatch assembly being adapted to include styling lines of said deck, said deck hatch assembly being provided in said upper deck surface on the port and starboard sides of said marine craft such that the hatch cover of each of said deck hatch assemblies assumes, in said open position, a gullwing-type configuration, whereby said area below said deck is ventilated and access through said hatch opening is provided.

2. The deck hatch assembly recited in claim 1 wherein each of said pivot mechanisms comprises a pivot plate secured to said independent rear edge of said hatch cover and a pin member secured to said side wall, said pivot plate being mounted for rotation upon said pin member.

3. The deck hatch assembly recited in claim 1 wherein each of said gas spring assemblies comprises a rod member having a first end and a second end, said first end of said rod member being pivotably secured to said side wall of said hatch cover, said second end of said rod member being slidably received within one end of a gas cylinder, the opposite end of said gas cylinder being pivotably secured to said raised ridge.

4. The deck hatch assembly recited in claim 1 wherein said hatch cover is provided with internal aluminum bracing.

5. The deck hatch assembly recited in claim 1 wherein said hatch cover, in said closed position, is structurally equivalent to said upper deck surface.

6. A deck hatch assembly for marine craft having a hull, a bulkhead, a deck and an upper deck surface, said deck hatch assembly comprising a submerged surface integrally formed in said upper deck surface and merging therewith by means of a pair of upper deck surface side walls and an upper deck surface rear wall, said submerged surface extending at one side through said bulkhead, a hatch opening formed in said submerged surface communicating with an area below said deck, a raised peripheral ridge surrounding said hatch opening and being formed integral with said upper deck surface, said raised peripheral ridge being defined by a planar top surface and first and second generally vertical walls, a seal secured around said hatch opening, a drainage channel defined between said ridge, said submerged surface and said upper deck surface side and rear walls, a hatch cover pivotably associated with said hatch opening, said hatch cover having a rear edge, a pair of pivot mechanisms securing said rear edge with respect to said hatch opening for pivotable movement of said hatch cover from a closed position wherein said hatch cover is supported by said top surface of said ridge so as to close off said hatch opening, to an open position wherein said hatch cover is raised upwardly from said bulkhead toward said marine craft whereby said hatch opening is uncovered and unobstructed, a pair of gas spring assemblies pivotably mounted between said hatch cover and proximate said ridge for retaining said hatch cover in said open position, said gas spring assemblies and said pivot mechanisms being located so as not to obstruct said hatch opening, said hatch cover being flush with said upper deck surface and said bulkhead in said closed position, said top surface of said ridge being adapted to uniformly support said hatch cover in said closed position, said submerged surface, said top surface of said ridge and said hatch cover all being parallel to each other, said ridge, said submerged surface, and said upper deck surface together being formed of an integral molding, said deck hatch assembly being adapted to include styling lines of said deck, said deck hatch assembly being provided in said upper deck surface on the port and starboard sides of said marine craft such that the hatch cover of each of said deck hatch assemblies assumes, in said open position, a gullwing-type configuration, whereby said area below said deck is ventilated and access through said hatch opening is provided.

* * * * *